US009862394B2

(12) United States Patent
Sandheinrich et al.

(10) Patent No.: US 9,862,394 B2
(45) Date of Patent: Jan. 9, 2018

(54) DOOR AND DOOR OPERATING ASSEMBLY FOR A RAILCAR AND METHOD OF ASSEMBLING THE SAME

(71) Applicant: American Railcar Industries, Inc., St. Charles, MO (US)

(72) Inventors: Glenn Sandheinrich, Weldon Spring, MO (US); Roger Dalske, Florissant, MO (US); Tom Toti, St. Charles, MO (US)

(73) Assignee: American Railcar Industries, Inc., St. Charles, MO (US)

( * ) Notice: Subject to any disclaimer, the term of this patent is extended or adjusted under 35 U.S.C. 154(b) by 574 days.

(21) Appl. No.: 14/505,668

(22) Filed: Oct. 3, 2014

(65) Prior Publication Data

US 2015/0096459 A1 Apr. 9, 2015

Related U.S. Application Data

(60) Provisional application No. 61/887,626, filed on Oct. 7, 2013.

(51) Int. Cl.

| | |
|---|---|
| ***B61D 7/00*** | (2006.01) |
| ***B61D 7/20*** | (2006.01) |
| ***B61D 7/02*** | (2006.01) |
| ***B61D 7/16*** | (2006.01) |
| ***B61D 7/26*** | (2006.01) |
| ***B61D 7/28*** | (2006.01) |

(52) U.S. Cl.

CPC ..... *B61D 7/20* (2013.01); *B61D 7/02* (2013.01); *B61D 7/16* (2013.01); *B61D 7/26* (2013.01); *B61D 7/28* (2013.01); *Y10T 29/49622* (2015.01)

(58) Field of Classification Search

CPC ... B61D 7/00; B61D 7/02; B61D 7/16; B61D 7/20; B61D 7/26; B61D 7/28

USPC ..... 105/249, 250, 251, 280, 282.1, 282.2, 105/282.3, 247, 248, 253, 286, 288, 305

See application file for complete search history.

(56) References Cited

U.S. PATENT DOCUMENTS

| | | | | |
|---|---|---|---|---|
| 2,600,357 A * | 6/1952 | Zimmerman | ..... | B61D 7/28 105/240 |
| 3,173,381 A * | 3/1965 | Franklin | ..... | B61D 7/26 105/240 |
| 3,298,745 A * | 1/1967 | Czapiewski | ..... | B60P 1/56 105/240 |

(Continued)

*Primary Examiner* — Jason C Smith

(74) *Attorney, Agent, or Firm* — Armstrong Teasdale LLP

(57) ABSTRACT

A door operating assembly for a railcar includes an actuating device. The railcar includes a railcar container and a lower portion coupled to the railcar container. The railcar container includes two opposing sidewalls and at least one door coupled to the lower portion. The railcar defines a longitudinal axis extending therethrough. The door operating assembly also includes at least one door operating mechanism coupled to the actuating device. At least a portion of the at least one door operating mechanism extends longitudinally along one sidewall of the two opposing sidewalls. The door operating assembly further includes at least one axial drive member coupled to the at least one door operating mechanism. The door operating assembly also includes at least one door drive assembly coupled to the at least one axial drive member. The at least one door drive assembly is coupled to the at least one door.

20 Claims, 8 Drawing Sheets

(56) References Cited

U.S. PATENT DOCUMENTS 3,577,932 A * 5/1971 Pulcrano ..... B61D 7/20 105/239
3,717,109 A * 2/1973 Miller ..... B61D 7/28 105/250
3,786,764 A * 1/1974 Beers, Jr. ..... B61D 7/28 105/240
3,902,434 A * 9/1975 Barnard ..... B61D 7/16 105/240
3,949,681 A * 4/1976 Miller ..... B61D 7/18 105/240
4,046,268 A * 9/1977 Adler ..... B61D 7/02 105/241.2
4,194,450 A * 3/1980 Miller ..... B61D 7/24 105/253
4,222,333 A * 9/1980 Schuller ..... B61D 7/24 105/250
4,222,334 A * 9/1980 Peterson ..... B61D 7/24 105/250
4,351,243 A * 9/1982 Brouwer ..... B61D 7/04 105/241.2
4,480,954 A * 11/1984 Manstrom ..... B61D 7/02 105/241.2
4,601,244 A * 7/1986 Fischer ..... B61D 7/18 105/240
4,606,277 A * 8/1986 Molloy ..... B61D 7/26 105/251
4,669,392 A * 6/1987 du Plessis ..... B61D 7/30 105/247
4,688,488 A * 8/1987 Adams ..... B61D 7/26 105/240
4,741,274 A * 5/1988 Ferris ..... B61D 7/18 105/240
4,766,820 A * 8/1988 Ritter ..... B61D 7/28 105/240
4,829,908 A * 5/1989 Hallam ..... B61D 7/28 105/240
4,884,511 A * 12/1989 Hallam ..... B61F 1/02 105/247
5,115,748 A * 5/1992 Westlake ..... B61D 7/28 105/240
5,131,722 A * 7/1992 DeCap ..... B60P 1/56 222/502
5,144,895 A * 9/1992 Murray ..... B61D 7/28 105/240
5,249,531 A * 10/1993 Taylor ..... B61D 7/28 105/240
5,261,333 A * 11/1993 Miller ..... B60P 1/56 105/240
5,448,954 A * 9/1995 Joubert ..... B61D 7/30 105/241.2
5,823,118 A * 10/1998 Mångnstrom ..... B61D 7/24 105/240
6,019,049 A * 2/2000 Gaydos ..... B61D 7/28 105/250
6,604,469 B1 * 8/2003 Galvan ..... B61D 7/26 105/289
6,955,126 B2 * 10/2005 Taylor ..... B61D 7/28 105/250
6,955,127 B2 * 10/2005 Taylor ..... B61D 7/26 105/299
7,051,661 B2 * 5/2006 Herzog ..... B61D 7/28 105/286
7,080,598 B2 * 7/2006 Creighton ..... B61D 7/28 105/247
7,080,599 B2 * 7/2006 Taylor ..... B61D 7/28 105/288
7,735,426 B2 * 6/2010 Creighton ..... B61D 7/02 105/286
8,485,110 B2 * 7/2013 Gaydos ..... B61D 7/26 105/247
8,596,203 B2 12/2013 Forbes et al.
2005/0168047 A1 * 8/2005 Grier ..... B60P 1/56 298/27
2006/0272541 A1 * 12/2006 Taylor ..... B61D 7/24 105/299
2011/0006592 A1 * 1/2011 Creighton ..... B60T 15/48 303/6.1
2012/0285346 A1 * 11/2012 Forbes ..... B61D 7/28 105/248
2015/0114253 A1 * 4/2015 Bis ..... B61D 7/18 105/251

* cited by examiner

DOOR AND DOOR OPERATING ASSEMBLY FOR A RAILCAR AND METHOD OF ASSEMBLING THE SAME

CROSS REFERENCE TO RELATED APPLICATIONS

This application claims the priority of Provisional Patent Application Ser. No. 61/887,626, entitled "DOOR AND DOOR OPERATING ASSEMBLY FOR A RAILCAR AND METHOD OF ASSEMBLING THE SAME", which was filed on Oct. 7, 2013, and which is hereby incorporated by reference in its entirety.

BACKGROUND

The present disclosure relates generally to railroad (railway) cars, or railcars and related components, and more particularly to a door and door operating assembly for a railcar and a method of assembling a railcar with such a door operating assembly.

Railcars have been used for many years to transport a wide variety of commodities. For example, railway tank cars transport fluids including liquids, e.g., demineralized water, and gasses, e.g., hydrogen. Also, for example, railway hopper cars transport flowable solids including coal, grains, and rock.

In some known examples, railcars have doors on the bottom of the cars which facilitate unloading of loaded commodities from the railcar. In at least some examples, door operating mechanisms for railcars are positioned underneath the railcars. Such a mechanism facilitates the operating of the doors and therefore controls the release of loaded commodities. Positioning the door operating mechanisms underneath the railcar poses challenges for maintenance and servicing of the door mechanisms due to the limited physical space available.

Accordingly, a method and apparatus for operating doors is desirable. Specifically, a door operating mechanism on the sidewall of the railcar will facilitate the operating and closing of railcar doors while also allowing the servicing of the door operating assembly.

BRIEF DESCRIPTION

In one aspect, a door operating assembly for a railcar is provided. The railcar includes a railcar container and a lower portion coupled to the railcar container. The railcar container includes two opposing sidewalls and at least one door coupled to the lower portion. The railcar defines a longitudinal axis extending therethrough. The door operating assembly includes an actuating device. The door operating assembly also includes at least one door operating mechanism coupled to the actuating device. At least a portion of the at least one door operating mechanism extends longitudinally along one sidewall of the two opposing sidewalls. The door operating assembly further includes at least one axial drive member coupled to the at least one door operating mechanism. The door operating assembly also includes at least one door drive assembly coupled to the at least one axial drive member. The at least one door drive assembly is coupled to the at least one door.

In another aspect, a railcar is provided. The railcar defines a longitudinal axis extending therethrough. The railcar includes a lower portion and a railcar container coupled to the lower portion. The railcar container includes two opposing sidewalls and at least one door coupled to the lower portion. The railcar also includes a door operating assembly. The door operating assembly includes an actuating device and at least one door operating mechanism coupled to the actuating device. At least a portion of the at least one door operating mechanism extends longitudinally along one sidewall of the two opposing sidewalls. The door operating assembly also includes at least one axial drive member coupled to the at least one door operating mechanism. The door operating assembly further includes at least one door drive assembly coupled to the at least one axial drive member. The at least one door drive assembly is coupled to the at least one door.

In another aspect, a method of assembling a railcar is provided. The railcar defines a longitudinal axis extending therethrough. The method includes providing a lower portion and a railcar container to the lower portion. The railcar container includes two opposing sidewalls and at least one door coupled to the lower portion. The method further includes coupling at least one door drive assembly to the at least one door. The method additionally includes coupling at least one axial drive member to the at least one door drive assembly. Moreover, the method includes coupling at least one door operating mechanism to the at least one axial drive member and extending at least a portion of the at least one door operating mechanism along one sidewall of the two opposing sidewalls substantially parallel to the longitudinal axis. The method also includes coupling an actuating device to the at least one door operating mechanism.

DRAWINGS

FIGS. 1-7 show example embodiments of the apparatus described herein.

FIG. 1 is a schematic side view of an example railcar;

FIG. 2 is an overhead perspective view of the example railcar shown in FIG. 1;

FIG. 3 is a schematic overhead view of the example railcar of FIG. 1 showing a hopper end sheet;

FIG. 4 is a schematic overhead view of the example railcar of FIG. 1 showing the view of components covered by the hopper end sheet shown in FIG. 3;

FIG. 5 is a schematic overhead view of an example door operating assembly that may be used with the railcar shown in FIG. 1;

FIG. 7 is a schematic overhead perspective view of the doors shown in FIGS. 1, 3, 4, and 5 with an example pair of door supports.

DETAILED DESCRIPTION

The example methods and apparatus described herein overcome at least some disadvantages of known railcars by providing a door operating assembly which is mounted on a lateral side of a railcar and thereby reduces the difficulty of operating, maintaining, and servicing the railcar.

Figure 1:
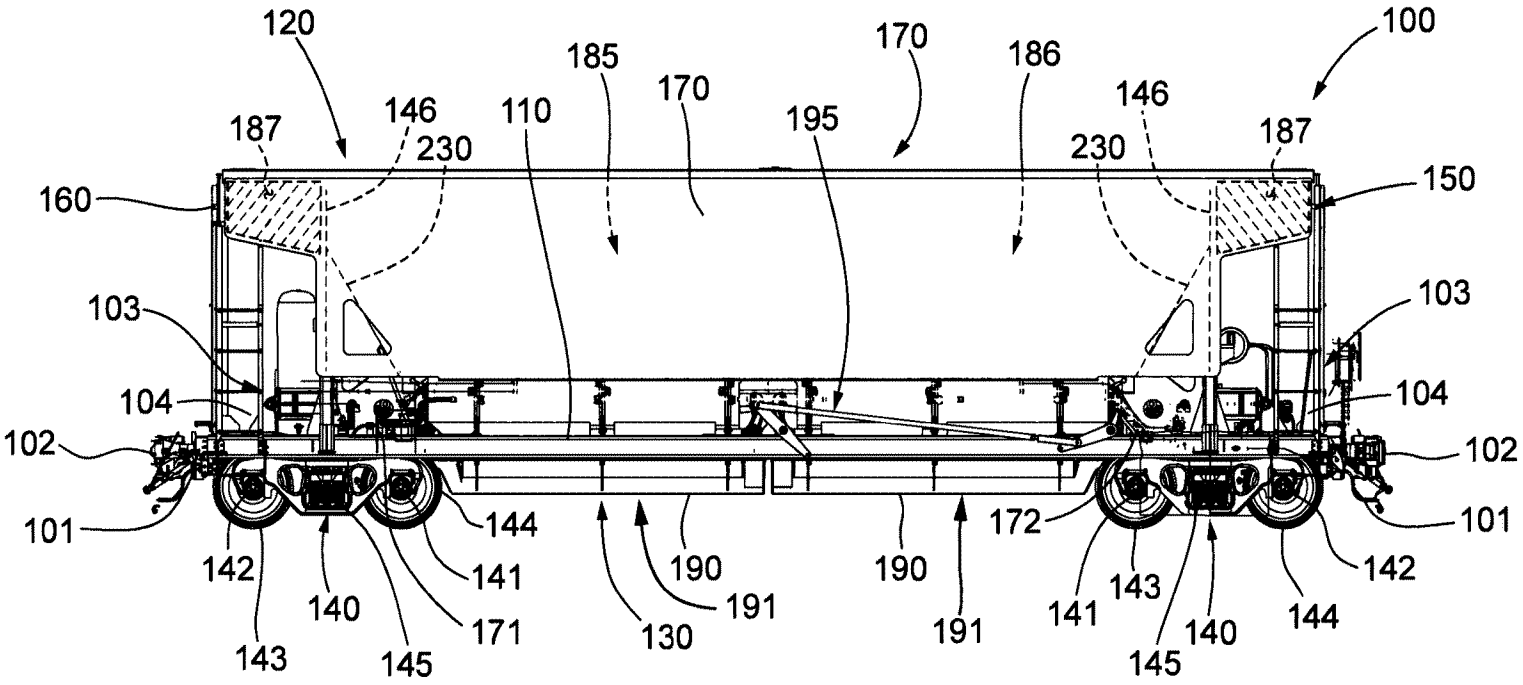

FIG. 1 is a side view of an example railcar 100. In the example embodiment, railcar 100 is an open-top gondola car. Railcar 100 is used to store and/or transport materials or commodities, such as, without limitation, dried distillers' grains, dried distillers' grains with solubles, coal, and/or any other suitable granular and/or flowable commodity material.

Alternatively, railcar 100 may be a closed-top transport vehicle. Also, alternatively, the apparatus described herein may be used with any type of railcar, e.g., without limitation, railway hopper cars, railway tank cars, and railway box cars.

In the example embodiment, railcar 100 includes a striker assembly 101 coupled to each end of a center sill assembly 110 and a coupling mechanism 102 coupled to each striker assembly 101. Railcar 100 also includes braking components 103 used to control the braking of railcar 100 during transit. Braking components 103 include, without limitation, hydraulic reservoir release rods and brake control valves (not shown). Railcar 100 also includes gate operating mechanisms 104. Gate operating mechanisms 104 include mechanisms to control the gate of railcar 100 including, without limitation, solenoids, tanks, and valves (not shown).

Also, in the example embodiment, railcar 100 includes an upper portion, i.e., a railcar container 120, which is coupled to a lower portion 130. Lower portion 130 includes center sill assembly 110. Lower portion 130 also includes a pair of truck assemblies 140 that each includes a pair of axles 141 and 142 that are coupled to a pair of wheels 143 and 144, respectively. Each truck assembly 140 also includes a bolster 145 that defines a bolster centerline 146. Railcar container 120 includes a front end structure 150, a rear end structure 160, and two opposing sidewalls 170 (a second opposing sidewall 170 shown obstructed by a first sidewall 170 in FIG. 1) extending therebetween, thereby at least partially defining a plurality of cargo cavities, i.e., hopper compartments 185 and 186. Center sill assembly 110 extends between front end structure 150 and rear end structure 160.

In the example embodiment, railcar 100 includes a plurality of hopper compartments 185 and 186 which are capable of being filled and emptied while railcar 100 is in motion. As used herein, hopper compartments 185 and 186 are used to receive and store commodities within railcar 100. Further, hopper compartments 185 and 186 are configured to be filled and emptied in unison and individually. Emptying operations are performed using a plurality of door operating assemblies (not shown in FIG. 1). Railcar 100 includes any number of hoppers and, accordingly, any number of associated hopper doors that enable operation of railcar 100 as described herein.

In addition to hopper compartments 185 and 186, railcar container 120, i.e., front end structure 150, rear end structure 160, and opposing sidewalls 170 further define supplemental commodity transport volumes 187 that represent additional portions of railcar 100 used to facilitate operations related to loading into railcar 100 and unloading commodities from railcar 100. Supplemental commodity transport volumes 187 are in flow communication with hopper compartments 185 and 186. In operation, supplemental commodity transport volumes 187 receive commodities and contain commodities therein.

Each hopper compartment 185 and 186 has at least one associated first door 190 and at least one second door 191 (second door 191 shown obstructed by a first door 190 in FIG. 1). Doors 190 and 191 are hingedly coupled to lower portion 130. First door 190 and second door are configured to facilitate containment of and release of commodities by using a door operating mechanism 195. Lower portion 130 additionally includes a pair of door supports 171 and 172 which provide support for first door 190. The location of door supports 171 and 172 facilitate a shorter railcar 100 because door supports 171 and 172 do not extend to axles 142.

Figure 2:
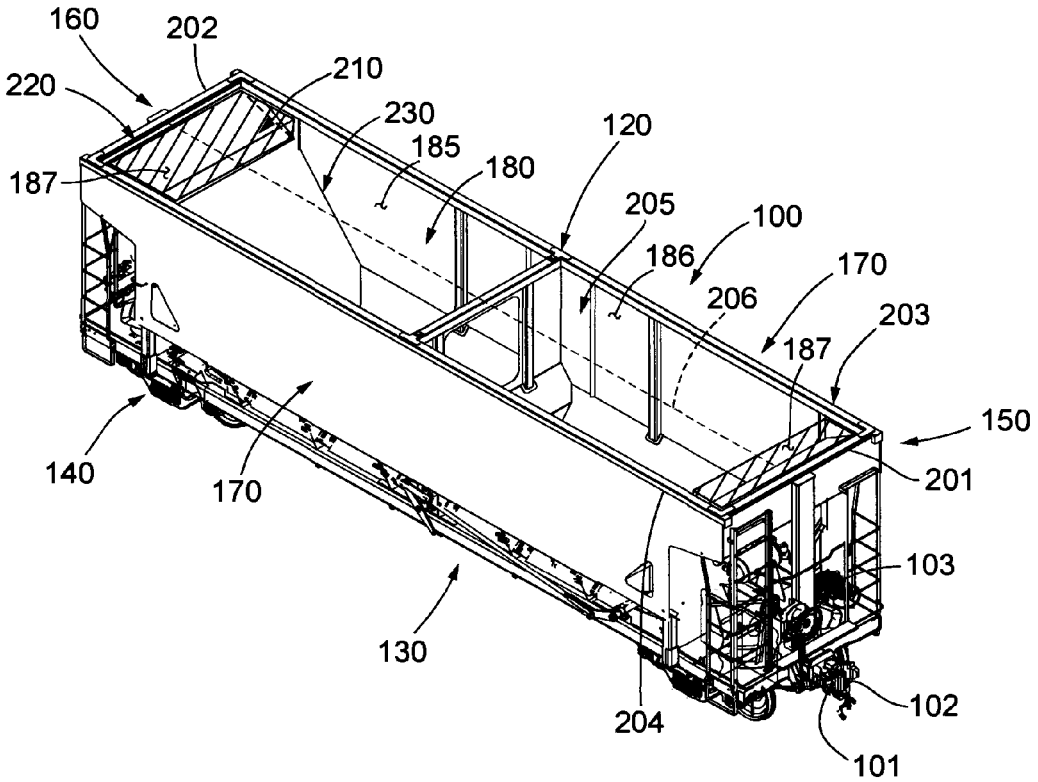

FIG. 2 is a schematic overhead perspective view of railcar 100. Railcar 100 includes a hopper end sheet 210. A front top edge 201 is defined by an upper portion of front end structure 150 and extends along the upper portion of front end structure 150. Similarly, a rear top edge 202 is defined by an upper portion of rear end structure 160 and extends along the upper portion of rear end structure 160. Additionally, a first lateral top edge 203 and a second lateral top edge 204 are defined on an upper portion of respective sidewall 170 and extend along the upper portion of respective sidewall 170. Railcar top plane 205 represents a plane defined by front top edge 201, rear top edge 202, first lateral top edge 203, and second lateral top edge 204. Railcar top plane 205 extends between edges 201, 202, 203, and 204. A railcar centerline longitudinal axis 206 is defined as extending between front top edge 201 and rear top edge 202.

Hopper end sheet 210 includes a first panel 220 and a second panel 230. First panel 220 is coupled to railcar 100 at front top edge 201 of front end structure 150. In the example embodiment, first panel 220 is also coupled to railcar 100 at rear top edge 202 of rear end structure 160. For first end structure 150, first panel 220 is coupled to front top edge 201 at a first angle with respect to railcar top plane 205. More specifically, first panel 220 is coupled to top edge 201 at a downward angle with respect to railcar top plane 205 within the range between approximately 20° and approximately 40°. Second panel 230 is coupled to first panel 220 at a second angle with respect to railcar top plane 205. More specifically, second panel 230 is coupled to first panel 220 at a downward angle with respect to railcar top plane 205 within the range between approximately 40° and approximately 65°. First panel 220 and second panel 230 for rear end structure 160 are substantially similar to those panels 220 and 230 for first end structure 150.

In the example embodiment, first panel 220 is a substantially rectangular flat panel. In the example embodiment, second panel 230 is a substantially flat panel. In alternative embodiments, first panel 220 and second panel 230 may be of any suitable shape to form hopper end sheet 210. The shape of hopper end sheet 210 facilitates loading commodities into hopper compartments 185. Although not shown in FIG. 2, a similar hopper end sheet 210 is used in conjunction with hopper compartment 186. The shape of hopper end sheet 210 also facilitates shielding at least a portion of braking components 103 and gate operating mechanisms 104 from direct sunlight. Hopper end sheet 210 additionally integrates supplemental commodity transport volume 187 into its design. First panel 220 extends longitudinally along railcar longitudinal axis 206 for a predetermined distance from second panel 230 such that first panel 220 can shield at least a portion of braking components 103 and gate operating mechanisms 104, from direct sunlight. First panel 220 defines a lower boundary for supplemental commodity transport volume 187. Therefore, supplemental commodity transport volume 187 defines a space which is used for storing, loading, and unloading commodities as well as for shielding at least a portion of braking components 103 and gate operating mechanism 104. In the example embodiment, braking components 103 and gate operating mechanisms 104 are substantially shielded from sunlight. In alternative embodiments, other components are shielded by hopper end sheet 210. In additional embodiments, other railcars (not shown) may be coupled to railcar 100 using coupling mechanism 102. At least a portion of braking components and gate operating mechanisms (not shown) of other railcars may additionally be substantially shielded from sunlight.

Figure 3:
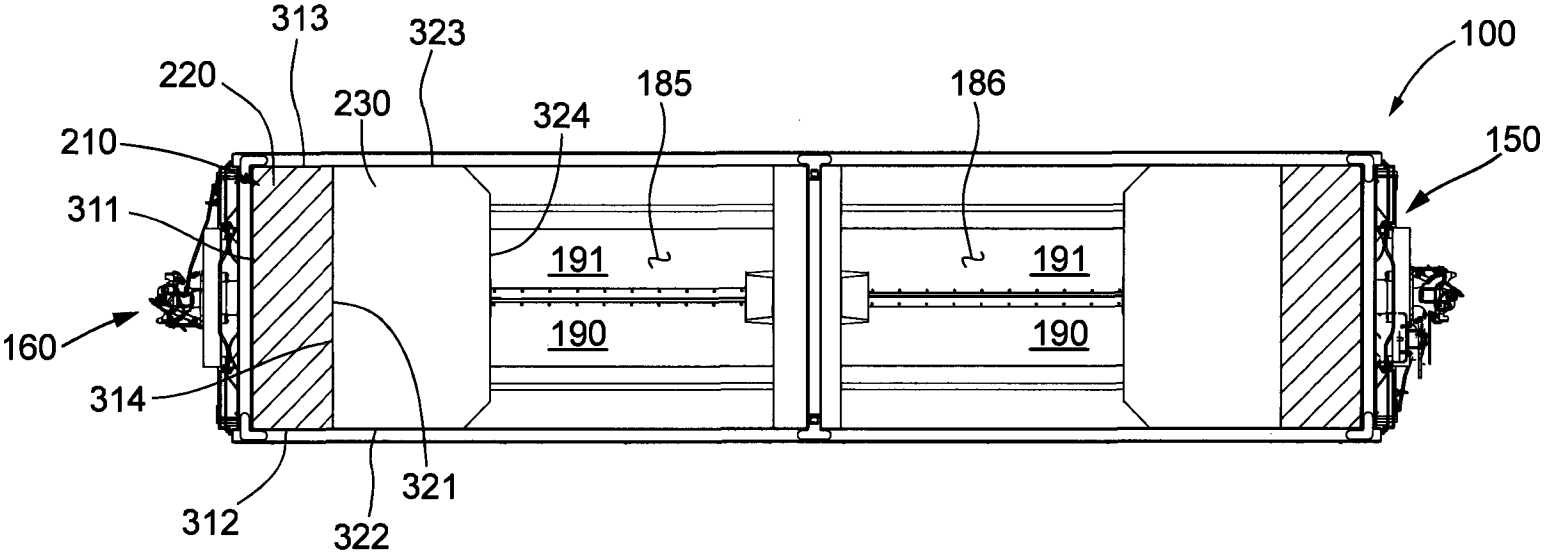

FIG. 3 is a schematic overhead view of railcar 100 showing an example hopper end sheet 210. In the example embodiment, railcar 100 is designed for top loading of commodities into railcar 100. As described above, hopper end sheet 210 includes a first panel 220 coupled to a second panel 230. Also, in the example embodiment, first panel 220 and second panel 230 are made of sheet metal. In alternative embodiments, first panel 220 and second panel 230 may be fabricated from any suitable material for receiving commodities including, for example, and without exception, alloys, composites, and durable plastics. First panel 220 includes an upper side 311, a first lateral side 312, a second lateral side 313, and a lower side 314. Accordingly, as described above, the shape of first panel 220 is substantially rectangular. Further, in the example embodiment, first panel 220 is coupled to railcar 100 through welding. In alternative embodiments, first panel 220 is coupled to railcar 100 using any appropriate method of coupling including, for example, and without limitation, adhesive bonding and mechanical fasteners. First panel 220 is coupled to railcar 100 at a downward angle. In the example embodiment, first panel 220 is additionally coupled to sidewalls 170 (shown in FIG. 2). First panel 220 extends slightly downward toward the base of first hopper compartment 185 within the range between 20° and 40° with respect to railcar top plane 205. In the example embodiment, first panel 220 extends downwards at approximately 30° with respect to railcar top plane 205. In alternative embodiments, first panel 220 extends at any angle suitable for the commodities loaded into railcar 100.

Second panel 230 includes an upper side 321, a first lateral side 322, a second lateral side 323, and a distal side 324. Second panel 230 is coupled to first panel 220 at the junction of lower side 314 and upper side 321. In the example embodiment, first panel 220 and second panel 230 are initially one panel (not shown) which is bent with a machine press to form two portions, first panel 220 and second panel 230. In an alternative embodiment, second panel 230 is coupled to first panel 220 through welding. In other alternative embodiments, second panel 230 is coupled to first panel 220 using any appropriate method of coupling including, for example, and without limitation, adhesive bonding and mechanical fasteners. In the example embodiment, second panel 230 is additionally coupled to sidewalls 170 using similar methods. Second panel 230 is coupled to first panel 220 at a downward angle. In other words, second panel 230 extends slightly downward into the base of first hopper compartment 185 at a steeper angle than first panel 220.

In operation, commodities are loaded into railcar 100 at first hopper compartment 185. At least a portion of commodities may land on hopper end sheet 210. Commodities generally slide down first panel 220 at a first speed and then accelerate down second panel 230 with a greater second speed. The angles chosen for first panel 220 and second panel 230 are chosen to mitigate the risk of damage to commodities while also facilitating the migration of commodities from hopper end sheet 210 to first hopper compartment 185. Enabling removal of commodities from hopper end sheet 210 reduces maintenance and cleaning required for hopper end sheet 210. By facilitating the migration of commodities to the base of railcar 100, hopper end sheet 210 additionally facilitates decreasing the falling of commodities onto the outer sections of railcar 100 such as coupling mechanism 102. Also, in operation, supplemental commodity transport volume 187 receives at least a portion of the commodities. Similar operations are used to load commodities into second hopper compartment 186.

Figure 4:
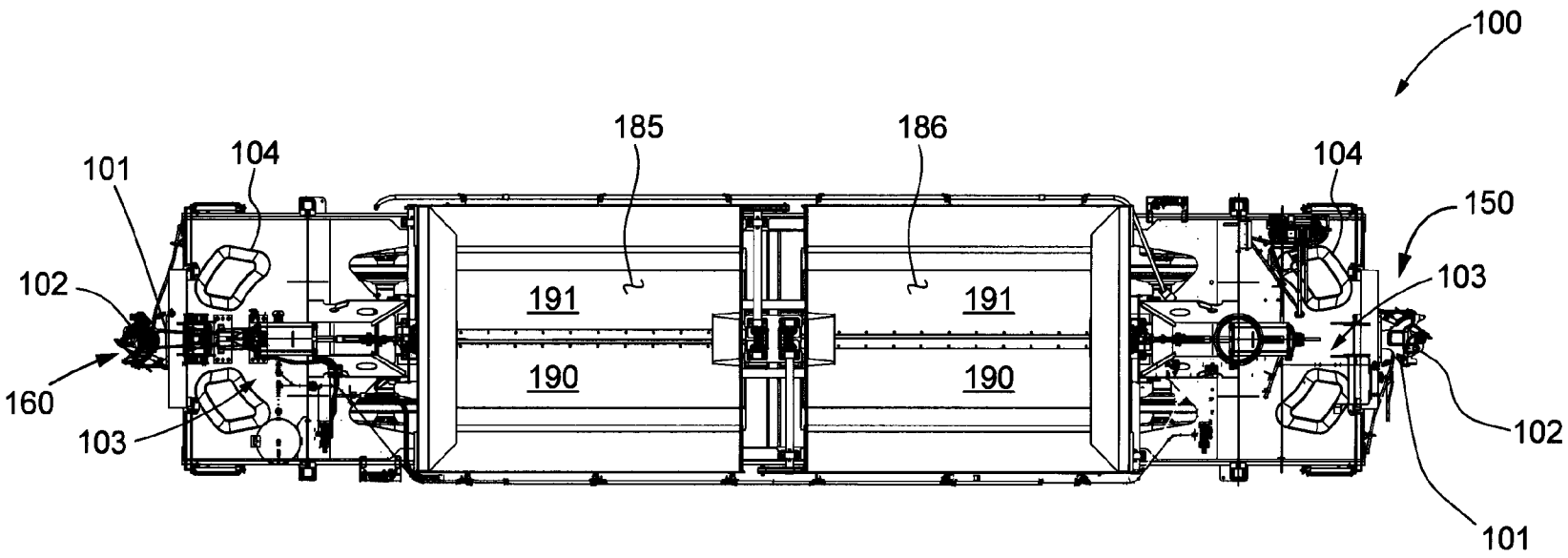

FIG. 4 is a schematic overhead view of railcar 100 showing the view of components 103 and 104 (i.e., braking components 103 and gate operating mechanisms 104) covered by hopper end sheet 210 (shown in FIGS. 1, 2, and 3). Hopper end sheet 210 is not visible in FIG. 4 because of the cutaway view. However, the cutaway view indicates that hopper end sheet 210 facilitates the reduction of direct sunlight on components 103 and 104. Accordingly, components 103 and 104 are exposed to less sunlight. Reduction of heat reduces adverse impact to human operators. Reduction of sunlight also reduces adverse impact to the service life of components 103 and 104. Also, in the event that there are residual commodities on components 103 and 104, reducing the direct sunlight reduces the potential for deleterious effects caused by the decomposition of commodities in sunlight.

Figure 5:
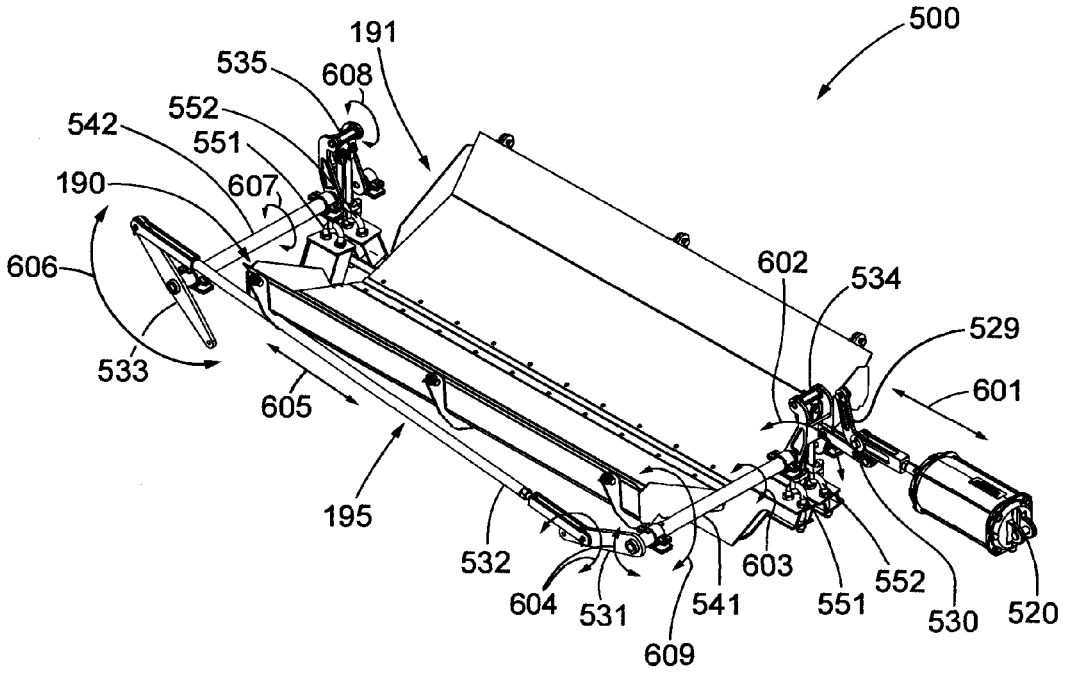
Figure 6A:
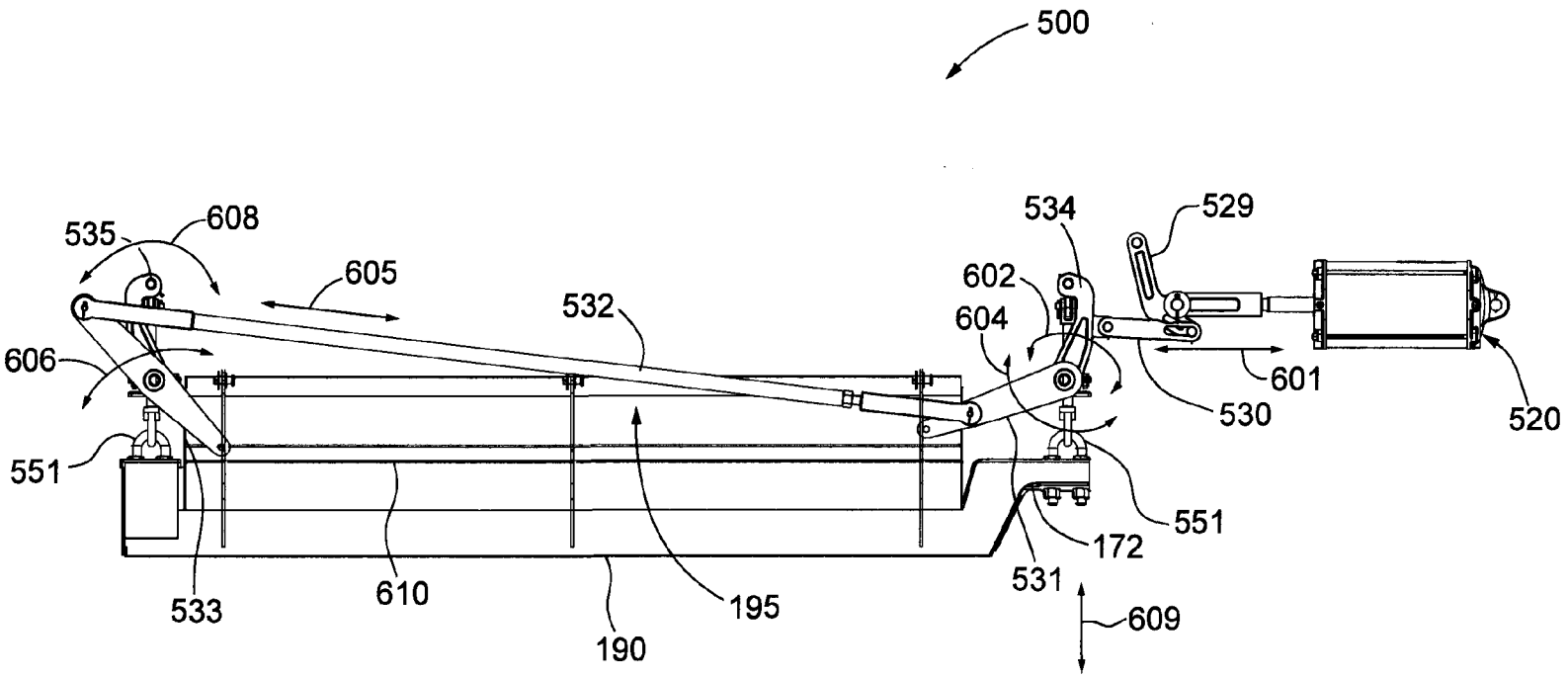
FIG. 6A is a schematic lateral perspective view of the example door operating assembly of FIG. 5 in a closed position.
Figure 6B:
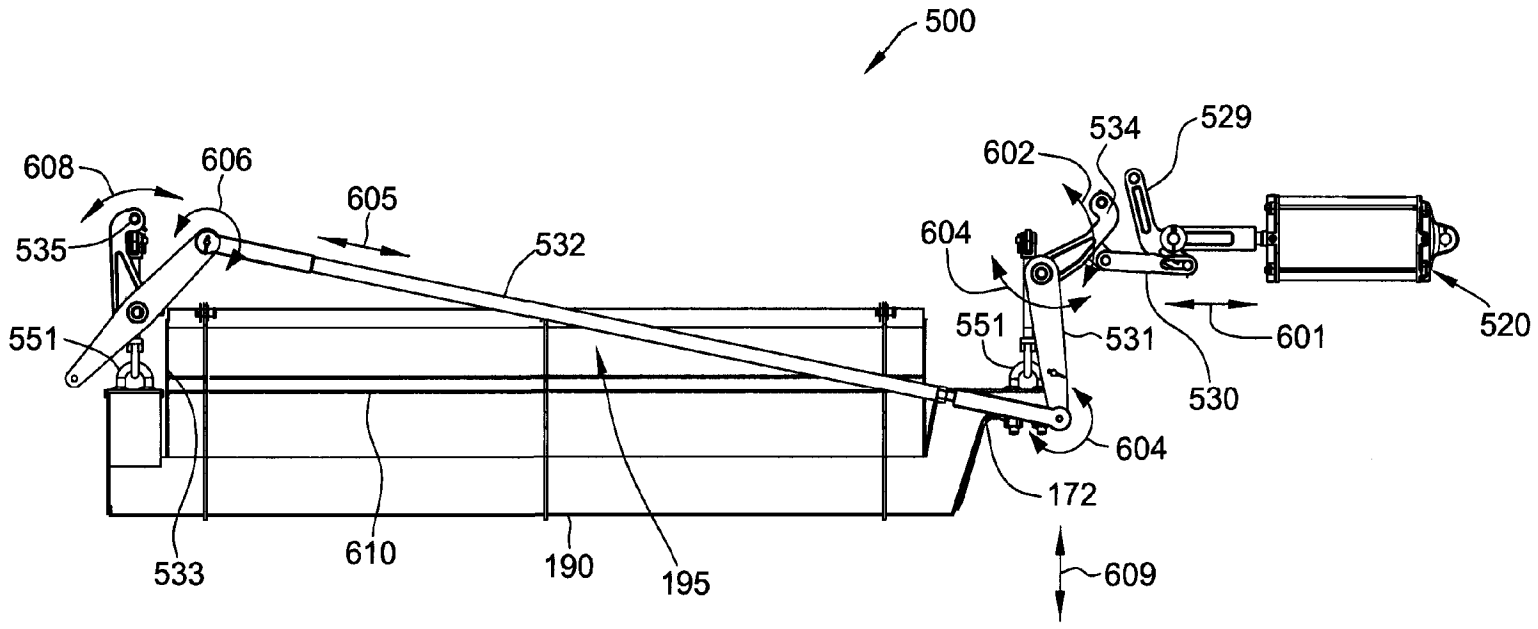
FIG. 6B is a schematic lateral perspective view of the example door operating assembly of FIG. 5 in an open position.

FIG. 5 is a schematic overhead perspective view of an example door operating assembly 500 that may be used with railcar 100 (shown in FIG. 1). Door operating assembly 500 functions to open and close first door 190 and second door 191. FIG. 6A is a schematic lateral view of door operating assembly 500 (shown in FIG. 5) in a closed position. FIG. 6B is a schematic lateral view of door operating assembly 500 (shown in FIG. 5) in a closed position. Doors 190 and 191 (shown in FIG. 5) are not shown in FIGS. 6A and 6B for clarity. Door operating assembly 500 facilitates the release of commodities stored in hopper compartments 185 and 186 (shown in FIGS. 1-4). Door operating assembly 500 includes actuating device 520 and door operating mechanism 195. Actuating device 520 provides driving force to door operating assembly 500 and thereby facilitates the opening and closing of first door 190 and second door 191. In the example embodiment, actuating device 520 is a pneumatic actuator. In alternative embodiments, actuating device 520 may be a hydraulic actuator, an electric actuator, a mechanical actuator, or any other actuating device 520 capable of providing force to door operating assembly 500.

In the example embodiment, door operating mechanism 195 includes a plurality of door operating members, i.e., door operating mechanism 195 includes seven door operating members 529, 530, 531, 532, 533, 534, and 535. In alternative embodiments, a greater or lesser amount of door operating members are used. Specifically, in the example embodiment, door operating member 529 is a first extension arm 529 that is directly coupled to actuating device 520 and door operating member 530 is a second extension arm 530 that is coupled to extension arm 529 and door operating member 534. Also, in the example embodiment, door operating member 531 is a first exterior pivoting member 531, door operating member 532 is a third extension arm 532, door operating member 533 is a second exterior pivoting member 533, door operating member 534 is a first undercarriage pivoting member 534, and door operating member 535 is a second undercarriage pivoting member 535. In addition to actuating device 520 and door operating mechanism 195, door operating assembly 500 includes a front axial drive member 541, a rear axial drive member 542, and a plurality of door drive assemblies 551 and 552. Further, in the example embodiment, actuating device 520 is located on an external portion of railcar 100. Alternately, actuating device 520 is located in an internal portion of railcar 100.

Arcually translatable first undercarriage pivoting member 534 is pivotally coupled to actuating device 520 through longitudinally translatable extension arms 529 and 530. First undercarriage pivoting member 534 is further pivotally coupled to front axial drive member 541. Front axial drive member 541 is also pivotally coupled to first exterior pivoting member 531. Also, first exterior pivoting member 531 is pivotally coupled to longitudinally translatable extension arm 532. Further, extension arm 532 is pivotally coupled to second exterior pivoting member 533. Additionally, second exterior pivoting member 533 is pivotally coupled to rotatable rear axial drive member 542. Rear axial drive member 542 is pivotally coupled to second undercarriage pivoting member 535. Second undercarriage pivoting member 535 is coupled to door drive assemblies 551 and 552.

Door operating members 529, 530, 531, 532, 533, 534, and 535 are coupled within door operating assembly 500 in the manner described. In alternative embodiments, door operating members 529, 530, 531, 532, 533, 534, and 535 may be configured, oriented, and coupled in any suitable fashion to enable the operation of door operating mechanism 195, and thereby door operating assembly 500 as described herein.

As described herein, door operating mechanism 195 includes front axial drive member 541 and rear axial drive member 542. Front axial drive member 541 and rear axial drive member 542 are each coupled to door drive assemblies 551 and 552. Door drive assemblies 551 and 552 are coupled to first door 190 and second door 191, respectively. Door operating mechanism 195 facilitates the transfer of force provided by actuating device 520 through front axial drive member 541 and rear axial drive member 542 such that door drive assemblies 551 and 552 alternately raise and lower first door 190 and second door 191.

FIGS. 6A and 6B illustrate a longitudinal centerline 610. Door operating mechanism 195 is mounted along a side of railcar 100 (shown in FIG. 1) extending longitudinally such that door operating members 531, 532, 533, 534, and 535 extend along one sidewall 170 (shown in FIG. 1) of railcar 100. In the example embodiment, door operating assembly 500 is coupled to railcar 100 without the use of additional structural support members, including, without exception, longitudinal tube bracing and traverse bracing. Such additional bracing may impede unloading of commodities using door operating assembly 500. Accordingly, maintenance and servicing of door operating mechanism 195 is easier to achieve because door operating members 529, 530, 531, 532, 533, 534, and 535 may be accessed without going under railcar 100. Alternatively, door operating mechanism 195 may be mounted to sidewall 170 by using any appropriate mounting materials including, for example, without limitation, brackets, bolts, and fasteners. Additionally, the components of door operating mechanism 195 may be coupled using any appropriate coupling methods. The lateral perspective view of FIGS. 6A and 6B also illustrates the coupling between door drive assembly 551 and first door 190 clearly. Although not shown, door drive assembly 552 and second door 191 (both shown in FIG. 5) are coupled similarly.

In operation, actuating device 520 induces a longitudinal force. More specifically, an operator (not shown) provides an input by, for example, and without limitation, pressing a button to activate actuating device 520 to open or close first door 190 and second door 191. Alternately, actuating device 520 may be triggered using a hot shoe system. A hot shoe system facilitates a device to be triggered by using a voltage potential to change from one state to a second state. For example, and without limitation, actuating device 520 can be triggered by a hot shoe system and accordingly cause doors 190 and 191 to alternately open and close.

Also, in operation, extension arms 529 and 530 translate longitudinally as shown by arrows 601, first undercarriage pivoting member 534 translates arcually as shown by arrows 602 and causes front axial drive member 541 to rotate as shown by arrows 603. Front axial drive member 541 pivotally translates first exterior pivoting member 531 as shown by arrows 604.

Further, in operation, first exterior pivoting member 531 causes extension arm 532 to longitudinally translate extension arm 532, second exterior pivoting member 533 pivotally translates as shown by arrows 605, second exterior pivoting member 533 causes rear axial drive member 542 to rotate as shown by arrows 607, rear axial drive member 542 causes second undercarriage pivoting member 535 to translate arcually as shown by arrows 608, and second undercarriage pivoting member 535 causes door drive assemblies 551 and 552 to move and thereby alternately open and close doors 190 and 191, where door drive assemblies 551 and 552 translate doors 190 and 191 arcually, respectively, as shown by arrows 609 (shown for door 190 only).

In at least some embodiments, door operating assembly 500 is operated manually. For example, if actuating device 520 is functionally unavailable due to service or maintenance issues, door operating assembly 500 can still function through mechanical motion. In one example, front axial drive member 541 can be moved using, for example, and without limitation, a comealong (not shown). In such an example, applying force to door operating assembly 500 can cause doors 190 and 191 to move from an open to a closed position. Alternately, rear axial drive member 542 may be moved using a comealong. In the example, applying force to door operating assembly 500 can cause doors 190 and 191 to move from a closed to an open position. Such methods of operating door operating assembly 500 may be advantageous in the event of the failure of a power source, such as the source of power for actuating device 520.

Door operating assembly 500 is additionally designed to facilitate the discharge of commodities while railcar 100 is standing in one location or in motion. Further, the design of door operating assembly 500 facilitates the discharge of such commodities between the rails of a railtrack. Door operating assembly 500 may additionally be used in railcars 100 with a plurality of hoppers. Accordingly, door operating assembly 500 may be used to allow the unloading of commodities from selected hoppers or all hoppers.

A method of assembling railcar 100 includes providing railcar container 120, railcar components 103 and 104, wherein components 103 and 104, and railcar container 120 are coupled to one another. Railcar container 120 additionally includes a front end structure 150 and a rear end structure 160. Railcar container 120 also includes a front top edge 201, a rear top edge 202, a first lateral top edge 203, and a second lateral top edge 204. Edges 201, 202, 203, and 204 define railcar top plane 205. The method further includes coupling first panel 220 to front end structure 150 or rear end structure 160 of railcar container 120. First panel 220 is coupled such that first panel 220 forms a first angle with plane 205. The method also includes coupling second panel 230 to first panel 220, wherein second panel 230 forms a second angle with plane 205.

The method of assembling railcar 100 further includes providing a center sill assembly 110 coupled to at least one truck assembly 140. Truck assembly 140 includes a plurality of axles 141 and 142. The method also includes providing at least one railcar container 120 coupled to the center sill assembly 110 and further coupled to the at least one truck assembly 140. Railcar container 120 includes opposing sidewalls 170. Railcar container 120 also includes a pair of doors 190 and 191 proximate portion 130 of railcar 100. The method also includes coupling a plurality of door drive assemblies 551 and 552 to pair of doors 190 and 191, respectively. The method additionally includes coupling front axial drive member 541 and rear axial drive member 542 to the plurality of door drive assemblies 551 and 552, respectively. The method further includes coupling door operating mechanism 195 to the front axial drive member 541 and rear axial drive member 542. The method also includes positioning door operating mechanisms 195 proximate one of sidewalls 170. The method further includes coupling an actuating device 520 to door operating mechanisms 195.

Figure 7:
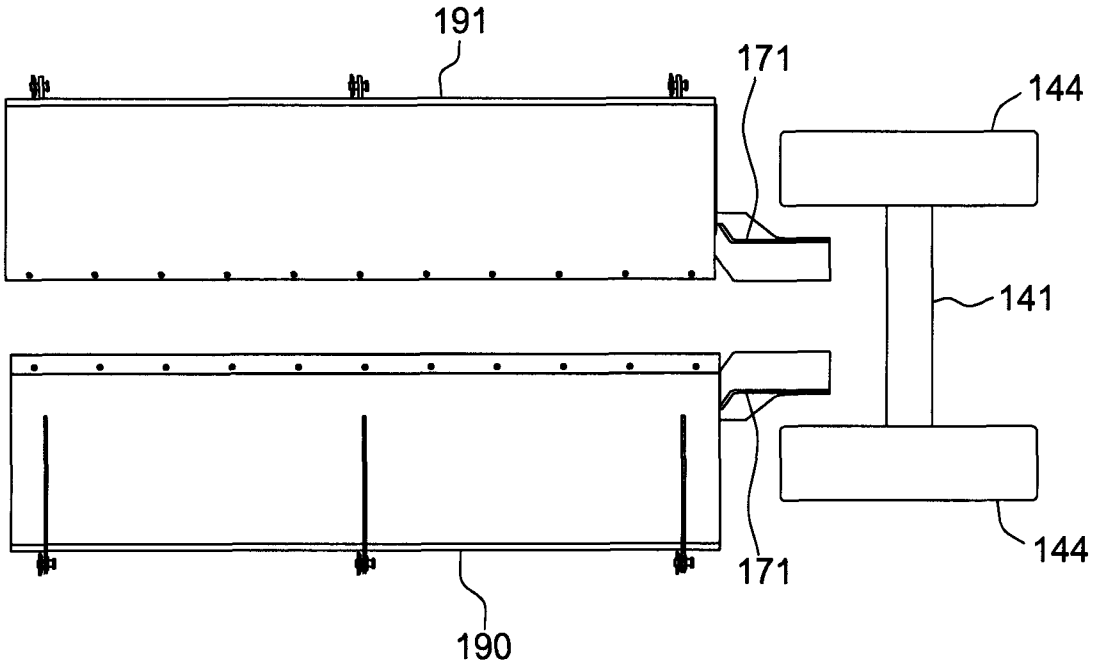

FIG. 7 is a schematic overhead perspective view of doors 190 and 191 shown with an example pair of door supports 171. As indicated in FIG. 7, door supports 171 are beveled so that they can rise over axle 141 without making contact with wheels 144. Accordingly, door supports 171 can contact center sill assembly 110 (shown in FIG. 1) without extending beyond the length of wheels 144. The beveling of door supports 171 accordingly facilitates a shorter railcar 100 because door supports 171 do not need to extend over wheels 144. Door supports 172 (shown in FIG. 1) are substantially similar to door supports 171.

The example methods and apparatus described herein overcome at least some disadvantages of known railcars by providing a door operating assembly which is mounted on a lateral side of a railcar and thereby reduces the difficulty of operating, maintaining, and servicing the railcar.

Also, example embodiments of a door operating assembly for a railcar and method of assembling/fabricating the same are described above in detail. The door operating assembly and method are not limited to the specific embodiments described herein, but rather, components of apparatus and/or steps of the method may be utilized independently and separately from other components and/or steps described herein. For example, the door operating assembly may also be used in combination with other railcars and associated assembly/fabrication methods, and are not limited to practice with only the railcar and assembly/fabrication methods as described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A door operating assembly for a railcar, the railcar including a railcar container and a lower portion coupled to the railcar container, the railcar container includes two opposing sidewalls and at least one door coupled to the lower portion, the railcar defining a longitudinal axis extending therethrough, said door operating assembly comprising:

an actuating device configured for translation in the longitudinal direction;

at least one door operating mechanism coupled to said actuating device, wherein at least a portion of said at least one door operating mechanism extends longitudinally along one sidewall of the two opposing sidewalls;

at least one axial drive member coupled to said at least one door operating mechanism; and at least one door drive assembly coupled to said at least one axial drive member, wherein said at least one door drive assembly is coupled to the at least one door.

2. The door operating assembly in accordance with claim 1, wherein said door operating assembly is configured to open and close the at least one door while the railcar is in motion.

3. The door operating assembly in accordance with claim 1, further comprising at least one door support positioned proximate to and above at least one axle of a plurality of axles.

4. The door operating assembly in accordance with claim 1, wherein said actuating device is at least one of a pneumatic actuating device, a hydraulic actuating device, an electric actuating device, a mechanical actuating device, and a manually operated actuating device.

5. The door operating assembly in accordance with claim 1, wherein said door operating assembly is configured to be operated using a hot shoe system.

6. The door operating assembly in accordance with claim 1, wherein said door operating assembly is configured to be operated manually through applying force to at least one of said at least one door operating mechanism and said at least one axial drive member.

7. The door operating assembly in accordance with claim 1, wherein said at least one door operating mechanism facilitates longitudinal translation.

8. The door operating assembly in accordance with claim 1, wherein said at least one axial drive member extends transversely between at least a first portion of said at least one door operating mechanism and a second portion of said at least one door operating mechanism.

9. A railcar defining a longitudinal axis extending therethrough, said railcar comprising:

a lower portion;

a railcar container coupled to said lower portion, wherein said railcar container comprises two opposing sidewalls and at least one door coupled to said lower portion; and a door operating assembly comprising:

an actuating device configured for translation in the longitudinal direction;

at least one door operating mechanism coupled to said actuating device, wherein at least a portion of said at least one door operating mechanism extends longitudinally along one sidewall of said two opposing sidewalls;

at least one axial drive member coupled to said at least one door operating mechanism; and at least one door drive assembly coupled to said at least one axial drive member, wherein said at least one door drive assembly is coupled to said at least one door.

10. The railcar in accordance with claim 9, wherein said door operating assembly is configured to open and close said at least one door while said railcar is in motion.

11. The railcar in accordance with claim 9, wherein said lower portion comprises a plurality of axles, said railcar further comprising at least one door support positioned proximate to and above at least one axle of said plurality of axles.

12. The railcar in accordance with claim 9, wherein said actuating device is at least one of a pneumatic actuating device, a hydraulic actuating device, an electric actuating device, a mechanical actuating device, and a manually operated actuating device.

13. The railcar in accordance with claim 9, wherein said door operating assembly is configured to be operated using a hot shoe system.

14. The railcar in accordance with claim 9, wherein said door operating assembly is configured to be operated manually through applying force to at least one of said at least one door operating mechanism and said at least one axial drive member.

15. The railcar in accordance with claim 9, wherein said at least one door operating mechanism facilitates longitudinal translation.

16. The railcar in accordance with claim 9, wherein said at least one axial drive member extends transversely between at least a first portion of said at least one door operating mechanism and a second portion of said at least one door operating mechanism.

17. A method of assembling a railcar, the railcar defining a longitudinal axis extending therethrough, said method comprising:

providing a lower portion;

coupling a railcar container to the lower portion, wherein the railcar container includes two opposing sidewalls and at least one door coupled to the lower portion;

coupling at least one door drive assembly to the at least one door;

coupling at least one axial drive member to the at least one door drive assembly;

coupling at least one door operating mechanism to the at least one axial drive member and extending at least a portion of the at least one door operating mechanism along one sidewall of the two opposing sidewalls substantially parallel to the longitudinal axis; and coupling an actuating device to the at least one door operating mechanism, wherein the actuating device is configured for translation in the longitudinal direction.

18. The method in accordance with claim 17, wherein the actuating device is coupled to an inner portion of the railcar and an outer portion of the railcar.

19. The method in accordance with claim 17, further comprising:

coupling at least one door support to the at least one door; and coupling the at least one door support to a truck assembly such that the at least one door support is positioned proximate to and above at least one axle of a plurality of axles.

20. The method in accordance with claim 17, wherein coupling the actuating device to the at least one door operating mechanism further comprises coupling at least one of a pneumatic actuating device, a hydraulic actuating device, an electric actuating device, a mechanical actuating device, and a manually operated actuating device to the at least one door operating mechanism.

* * * * *